US011083661B2

(12) United States Patent
Andrews

(10) Patent No.: US 11,083,661 B2
(45) Date of Patent: Aug. 10, 2021

(54) DUAL HAND CONTROLLED DEVICE FOR LEG STRETCHING AND/OR ACTIVATION

(71) Applicant: Stuart Andrews, Kingston (AU)

(72) Inventor: Stuart Andrews, Kingston (AU)

( * ) Notice: Subject to any disclaimer, the term of this patent is extended or adjusted under 35 U.S.C. 154(b) by 165 days.

(21) Appl. No.: 15/762,935

(22) PCT Filed: Oct. 18, 2016

(86) PCT No.: PCT/AU2016/050979
§ 371 (c)(1),
(2) Date: Mar. 23, 2018

(87) PCT Pub. No.: WO2017/066828
PCT Pub. Date: Apr. 27, 2017

(65) Prior Publication Data

US 2018/0296420 A1 Oct. 18, 2018

(30) Foreign Application Priority Data

Oct. 19, 2015 (AU) ..... 2015904274

(51) Int. Cl.
*A61H 1/02* (2006.01)
*A63B 23/035* (2006.01)
(Continued)

(52) U.S. Cl.
CPC ..... *A61H 1/0237* (2013.01); *A61H 1/02* (2013.01); *A61H 15/00* (2013.01);
(Continued)

(58) Field of Classification Search
CPC ..... A63B 2023/006; A63B 21/002; A63B 21/0023; A63B 21/4019; A63B 21/4009; A63B 21/154; A63B 2208/0238; A63B 21/4015; A63B 2208/0252; A63B 23/03575; A63B 21/00185; A61H 1/0237; A61H 1/0244; A61H 1/0255; A61H 1/02; A61H 2201/1269; A61H 2203/0456; A61H 2203/0425; A61H 2201/1652;
(Continued)

(56) References Cited

U.S. PATENT DOCUMENTS 3,462,142 A * 8/1969 Sterndale ..... A63B 21/018 482/120
3,858,874 A * 1/1975 Weider ..... A63B 21/154 482/131

(Continued)

*Primary Examiner* — Nyca T Nguyen
(74) *Attorney, Agent, or Firm* — Kilpatrick Townsend & Stockton LLP

(57) ABSTRACT

An independent stretching device comprises a back brace configured to pass across and brace against a user's back. A first connector is secured to a first end of the lower back brace, and is threaded through a first pulley. A second connector is secured to a second end of the lower back brace on an opposite side of the user to the first end of the back brace, the second connector being threaded through a second pulley. A foot stirrup is provided for receiving a foot of the user, and has a first end connected to the first pulley and a second end connected to the second pulley. Tension applied to respective distal ends of the first and second connectors distal from the back brace creates tension which urges the foot stirrup and the back brace toward each other.

14 Claims, 10 Drawing Sheets

(51) Int. Cl.
*A63B 21/00* (2006.01)
*A61H 15/00* (2006.01)

(52) U.S. Cl.
CPC ..... *A61H 2201/0192* (2013.01); *A61H 2201/1269* (2013.01); *A61H 2201/1276* (2013.01); *A61H 2201/164* (2013.01); *A61H 2201/1635* (2013.01); *A61H 2201/1652* (2013.01); *A61H 2203/0425* (2013.01); *A61H 2203/0456* (2013.01); *A63B 21/154* (2013.01); *A63B 21/4009* (2015.10); *A63B 21/4015* (2015.10); *A63B 21/4019* (2015.10); *A63B 23/03575* (2013.01); *A63B 2208/0238* (2013.01); *A63B 2208/0252* (2013.01)

(58) Field of Classification Search
CPC ..... A61H 2201/164; A61H 2201/1635; A61H 2201/1276; A61H 2201/0192; A61H 2001/0207
See application file for complete search history.

(56) References Cited

U.S. PATENT DOCUMENTS 3,999,752 A * 12/1976 Kupperman ..... A63B 21/154 482/131
4,456,249 A * 6/1984 Calabrese ..... A63B 21/154 482/124
4,588,186 A * 5/1986 Calabrese ..... A63B 21/154 482/131
4,634,118 A * 1/1987 Jensen ..... A63B 21/06 482/133
4,735,412 A * 4/1988 Prsala ..... A63B 21/055 482/125
5,129,647 A * 7/1992 Castellanos ..... A63B 21/055 482/124
5,176,377 A * 1/1993 Wilkinson ..... A63B 21/00069 482/114
5,277,680 A 1/1994 Johnston
D358,625 S * 5/1995 Enriquez, Jr. ..... D21/686
5,484,360 A * 1/1996 Haber ..... A63B 7/04 482/37
5,518,486 A 5/1996 Sheeler
5,713,821 A * 2/1998 Nissen ..... A63B 21/154 482/114
6,328,677 B1 * 12/2001 Drapeau ..... A63B 22/0076 482/55
8,403,817 B2 * 3/2013 Ferguson ..... A63B 21/4025 482/74
2003/0223808 A1 * 12/2003 Kuo ..... A63B 21/0552 403/220
2004/0029689 A1 * 2/2004 Contreras ..... A61H 1/0244 482/148
2005/0101461 A1 * 5/2005 Johnson ..... A63B 21/0004 482/141
2009/0258768 A1 10/2009 Clarke
2010/0152003 A1 * 6/2010 Haas ..... A63B 69/0057 482/95
2011/0011672 A1 * 1/2011 Price, Jr. ..... A62B 1/14 182/5
2011/0034307 A1 * 2/2011 Eddy ..... A63B 21/00 482/131
2011/0173780 A1 * 7/2011 Lipke ..... A62B 1/06 24/115 R
2012/0202656 A1 * 8/2012 Dorsay ..... A63B 21/156 482/121
2013/0256061 A1 * 10/2013 Codega ..... A62B 1/14 182/241
2014/0073496 A1 3/2014 Bannerman
2014/0174850 A1 * 6/2014 Paglioli ..... A62B 1/14 182/5
2014/0342884 A1 * 11/2014 Aldridge ..... A61H 1/0237 482/131
2015/0018136 A1 * 1/2015 Goldstein ..... B33Y 80/00 473/513
2015/0165692 A1 * 6/2015 Morrow ..... B29C 64/386 700/98
2015/0343253 A1 * 12/2015 Nikkaran ..... A63B 21/068 482/96

* cited by examiner

DUAL HAND CONTROLLED DEVICE FOR LEG STRETCHING AND/OR ACTIVATION

This application is a U.S. National Stage of International Application No. PCT/AU2016/050979 filed on Oct. 18, 2016, which claims priority from Australian Patent Application No 2015904274, filed on Oct. 19, 2015, which is hereby incorporated by reference in its entirety.

TECHNICAL FIELD

The present invention relates to a hand controlled leg stretch device for stretching the leg muscles of the user, and in particular provides a dual interdependent, hand controlled leg stretching device that utilises two horizontally opposed pulleys or sheaveless blocks which allows the feet and legs to be substantially aligned with the lower back of the user and avoid or minimise loads associated with unnecessary spinal flexion.

BACKGROUND OF THE INVENTION

There is a direct relationship between the lower back and the leg muscle groups. For example the sciatic nerve begins in the lower back and runs through the buttocks and down the lower limbs. The sciatic nerve is the largest nerve in the human body. Sciatica is a set of symptoms not a diagnosis. Therefore in this and other examples it makes sense that when people experience lower back-related symptoms with accompanying discomfort in their lower limbs that the interrelationship between the two areas be considered in the overall treatment and ongoing self-management of these conditions. Often tight calves and hamstrings stop an individual from bending over in a biomechanically efficient manner, and, as a result of this tightness, the lower back becomes overloaded resulting in lower back discomfort. Conversely, if the lower back is inflamed/irritated this can cause neuromuscular related discomfort causing the leg musculature to tighten up; which in turn leads to increased discomfort when the individual tries everyday movements such as walking, sitting up or down, bending over etc.

Past devices for leg stretching include simple bands or belts which are looped around the foot of the user. The user subsequently holds a length of belt in each hand and pulls the belt towards themselves in order to initiate a stretch of a leg muscle. However, due to the opposed forces applied to the belt applied via the arms of the user the shoulders and upper spine typically roll forward, creating an unwanted bend in the upper spine as well as placing unnecessary stress on the lower back. Such devices typically do not cater for users of differing height, girth and/or flexibility, and can thus inappropriately pre-tension the user's muscles or misplace the user's limbs prior to use or when finishing use.

Other past devices have been proposed which are not stand-alone or independent devices, as they depend on an attachment to a fixture such as a doorjamb, or door handle or external frame to provide a brace or resistance point.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides an independent stretching device comprising:

a back brace configured to pass across and brace against a user's back;

a first connector secured to a first end of the lower back brace, the first connector being threaded through a first pulley;

a second connector secured to a second end of the lower back brace on an opposite side of the user to the first end of the back brace, the second connector being threaded through a second pulley; and a foot stirrup for receiving a foot of the user, the foot stirrup having a first end connected to the first pulley and a second end connected to the second pulley;

whereby tension applied to a distal end of the first connector distal from the back brace, and tension applied to a distal end of the second connector distal from the back brace creates tension which urges the foot stirrup and the back brace toward each other.

According to a second aspect the present invention provides a method of independent stretching, the method comprising:

positioning a back brace across, and braced against, a user's back;

positioning a foot of the user in a foot stirrup; and applying tension to distal ends of first and second connectors which each extend from the respective distal end through respective first and second pulleys secured to respective first and second ends of the foot stirrup and which each extend from the respective pulley to be secured to respective first and second ends of the back brace on opposite sides of the user, to thereby urge the foot stirrup and the back brace toward each other.

According to a third aspect the present invention provides a non-transitory computer readable medium for independent stretching, comprising instructions making up a digital blueprint file which, when executed by one or more processors, causes performance of the following:

three-dimensional printing of a back brace configured to pass across and brace against a user's back;

three-dimensional printing of a first connector secured to a first end of the lower back brace, the first connector being threaded through a first pulley;

three-dimensional printing of a second connector secured to a second end of the lower back brace on an opposite side of the user to the first end of the back brace, the second connector being threaded through a second pulley; and three-dimensional printing of a foot stirrup for receiving a foot of the user, the foot stirrup having a first end connected to the first pulley and a second end connected to the second pulley;

whereby in use tension applied to a distal end of the first connector distal from the back brace, and tension applied to a distal end of the second connector distal from the back brace creates tension which urges the foot stirrup and the back brace toward each other.

In some embodiments of the invention the back brace is releasably fastenable around the torso of the user, for example by use of suitable waist harness buckle and/or a snap-clip side release buckle. The back brace may be configured to pass across any suitable portion of the user's back, from the buttocks or sacral region of the back to the shoulders, however in preferred embodiments the back brace may comprise a lower back brace, which for example may be fastenable around the lower back and waist of the user.

The first and second connector may each comprise any suitable element capable of holding tension between the back brace and the respective pulley, and capable of travelling around the pulley, and for example either connector or both connectors may comprise any one or more of a flexible rope, a cord, a line, a strap, a sash, a braid, a cable, or a chain such as a fabric chain. The connectors may partly comprise an inflexible element such as a rod at least in sections in which the connector is not required to pass through the respective pulley.

In preferred embodiments a first handle is secured to an end of the first connector distal from the back brace, whereby the first pulley is interposed between the first handle and the back brace. Similarly, in some embodiments a second handle is secured to an end of the second connector distal from the back brace, whereby the second pulley is interposed between the second handle and the back brace. However in alternative embodiments the first connector and/or second connector may be provided with no handle and may simply be grasped by the user directly.

The foot stirrup in some embodiments may be configured to only receive one foot of the user at a time. However in other embodiments the foot stirrup may be capable of receiving either one foot of the user or both feet of the user at a time.

In some embodiments a single pulley may be provided for each connector, each pulley secured to the foot stirrup as described above. In other embodiments an additional pulley may be provided on each connector, the additional pulley being secured to the back brace and the connector being threaded through both respective pulleys in a manner to effect a mechanical advantage of greater than two. Notably, in such embodiments, the tension applied to the user's back and arms on the one hand and to the foot stirrup on the other hand will remain equal, however the load borne by the user's arms can be made unequal to and less than the load borne by the back brace, which may be advantageous for example for users having less arm strength by easing the task of both building tension and holding tension in the connectors.

Each pulley may comprise a sheaved block. However, in other embodiments one or more of the pulleys may comprise a sheaveless block, and such embodiments may be advantageous in exploiting a lower dynamic friction to permit the user to easily build tension in the connectors, while exploiting a higher static friction to assist the user to more easily hold the connectors stationary while under tension.

In such embodiments, the pulleys comprising a sheaveless block are preferably formed entirely, or at least formed on friction surfaces, of a material having a high static coefficient of friction.

Moreover, in embodiments comprising one or more sheaveless blocks, the or each sheaveless block is preferably configures to present a friction surface which takes a shape which maximises static friction, and for example may present a substantially elliptical, catenary or parabolic friction surface configured to reduce dynamic friction during connector movement through the pulley while maximising static friction when the connector is stationary in the pulley and under tension. Maximising static friction is advantageous in easing the load borne by the user's hands and arms while in a static stretching position with the connectors under tension, particularly given that a stretch is typically held for a significantly greater amount of time than is required to enter the stretch. The or each sheaveless block in such embodiments is preferably formed of a mouldable material to enable device properties such as friction and strength to be adjusted by altering a material mix used in an injection moulding process to form the block, without having to alter a mould itself. The or each sheaveless block in such embodiments is preferably formed of Nylon 6/6 or Nylon 6.

Preferred embodiments thus share tension unequally between the user's arms and the back brace, with the back brace bearing a higher load, and as noted above this may be effected by use of sheaveless blocks and/or by providing a mechanical advantage greater than two. Such embodiments thus preferentially pull the user's lower back towards the feet, motivating an upright spine and discouraging a slumped or curved lumbar region, while simultaneously minimising the forward force applied to the user's arm's and thus minimising any undesirable forward roll of the shoulders. Shoulder roll is in any event counteracted by the simple act of the user grasping the connectors and pulling, as this motion tends to motivate the shoulders to draw back as the stretch is entered into. Embodiments of the present invention thus encourage a posturally appropriate upright seated stretching position which can be particularly important for individuals who are very restricted in their leg muscle groups such as the hamstrings and in the lower back and/or can act as an aid to the elderly or disabled who tend to have trouble holding the desired alignment of the lower back when stretching.

In some embodiments the length of the foot stirrup may be adjustable by providing one or more buckles upon the foot stirrup.

In some embodiments of the invention, a point at which the first connector is secured to the first end of the lower back brace may be made to be adjustable, for example by use of a first ladder lock system. In some embodiments of the invention, a point at which the second connector is secured to the second end of the lower back brace may be made to be adjustable, for example by use of a second ladder lock system.

BRIEF DESCRIPTION OF THE DRAWINGS

An example of the invention will now be described with reference to the accompanying drawings, in which.

DESCRIPTION OF THE PREFERRED EMBODIMENTS

Figure 1:
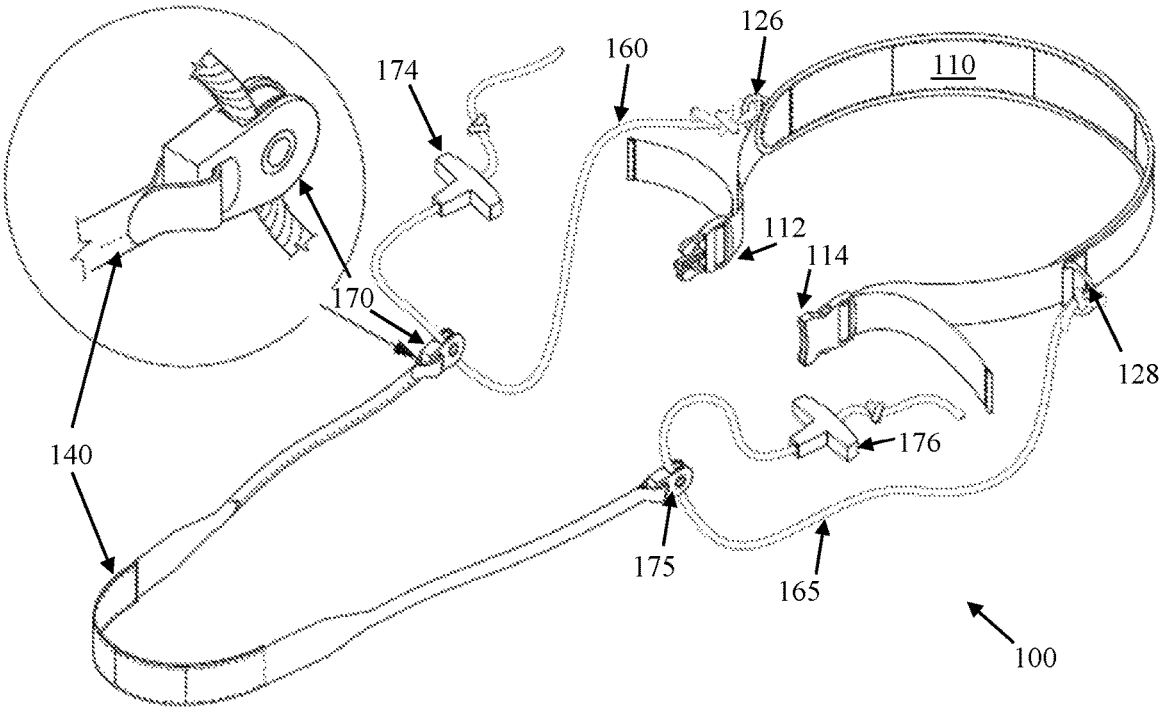
FIG. 1 illustrates a hand controlled leg stretching and activation device in accordance with one embodiment of the present invention.

FIG. 1 illustrates a hand controlled leg stretching device 100 according to a preferred embodiment of the invention. The leg stretching device 100 comprises a lower back brace 110. The lower back brace 110 fits around the lower back/lumbar region and waist of the user such that ends of the lower back brace 110 are fastenable to each other through the use of a side release clip buckle 112, 114. The buckle 112, 114 is adjustable and allows the girth of the lower back brace 110 to be adjusted to snugly hold the waist of the current user.

The lower back brace 110 has affixed rings 126, 128, positioned such that when the brace 110 is worn by the user each of the rings 126 and 128 is located approximately at the respective hip of the user. The first and second rings 126, 128 are D-shaped metal rings fastened to the lower back brace 110 by stitching.

Fastened to the first ring 126 is a first end of a first rope 160, and fastened to a second ring 28 is the first end of a second rope 165. The first rope 160 passes through and engages a first singular pulley mechanism 170, whilst the second rope 165 passes through and engages a second singular pulley mechanism 175.

In the embodiment of FIG. 1 a first handle 174 is threaded onto the first rope 160 and fastened at the second end of the first rope 160. Similarly, a second handle 176 is threaded onto the second rope 165 and fastened at a second end of the second rope 165. The first and second handles 174 and 176 may be fastened to the respective first rope 160 and second rope 165 using any suitable means. In this embodiment each handle 174, 176 is slidably threaded onto the respective rope 160, 165, and a knot is tied at each of the second ends of the first and second ropes 160, 165. Advantageously, this allows the used length of each of the first rope 160 and second rope 165 to be adjusted appropriate to the size of the user if required.

Foot stirrup 140 at a first end is fixed to the first singular pulley mechanism 170, and at a second end is fixed to the second singular pulley mechanism 175. The foot stirrup 140 is made of a flat webbing which allows the foot stirrup to be placed flat across the ball of the foot of a user whilst performing a calf stretch, or located flat against the heel of the foot whilst performing a hamstring stretch. The flat webbing helps to distribute the load placed on the foot which is important due to the foot being sensitive to pressure whilst engaging in a stretch.

The use of the two horizontally spaced apart singular pulley mechanisms 170, 175 allows the feet and legs to be positioned in approximately the same alignment as the lower back/hips so as to avoid any unnecessary loads resulting in unwanted spinal flexion or curve in the spine.

Additionally the two singular pulley mechanisms 170, 175 each provide a mechanical advantage as the user pulls on the respective handles 174 and 176, so that the tension applied by the user by pulling with each hand on the respective handle needs only be half of the net tension applied to that side of the foot stirrup, so that the summation of forces applied to both singular pulleys 170 and 175 means that the net force applied to the foot stirrup is approximately four times the force applied by each hand. This mechanical advantage also allows a sizable force to be generated in the back brace 110 to thereby keep the spine in substantially perpendicular alignment to the legs of the user, because a user is able to pull back towards their torso, keeping their elbows close to the torso and avoiding any bending, or avoiding excessive bending, of the upper spine and neck.

Figure 2A:
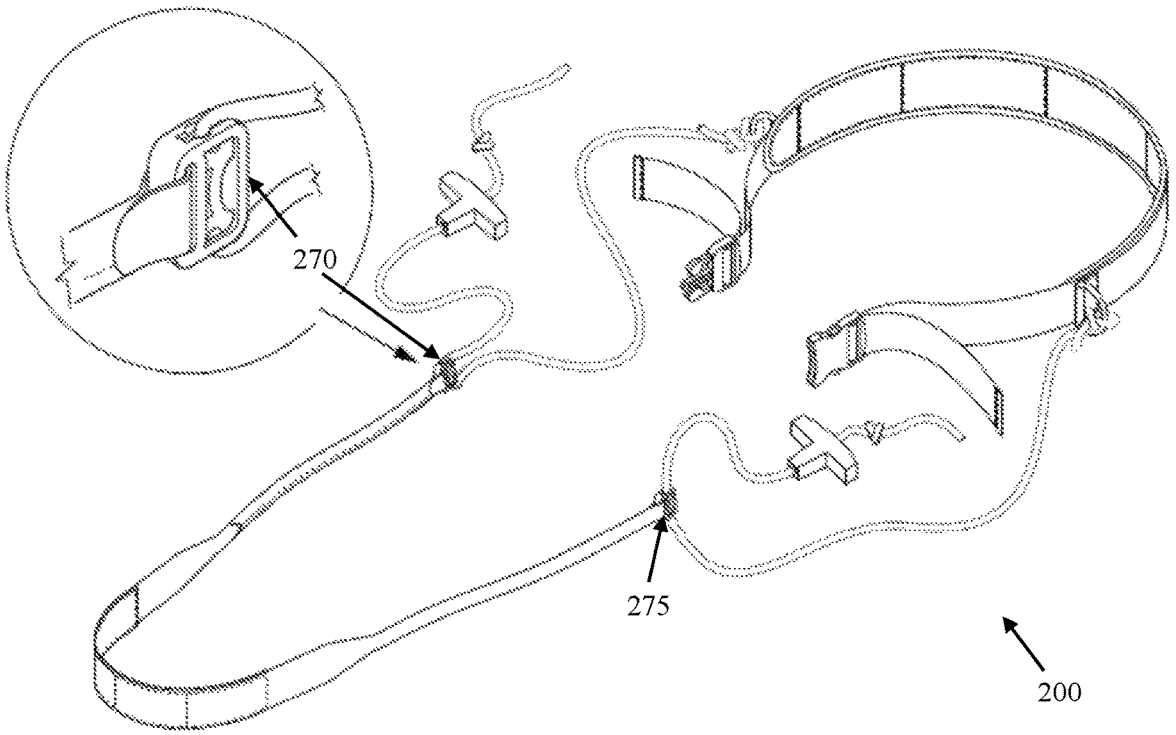
FIG. 2 illustrates a hand controlled leg stretching and activation device in accordance with another embodiment of the present invention.
Figure 2B:
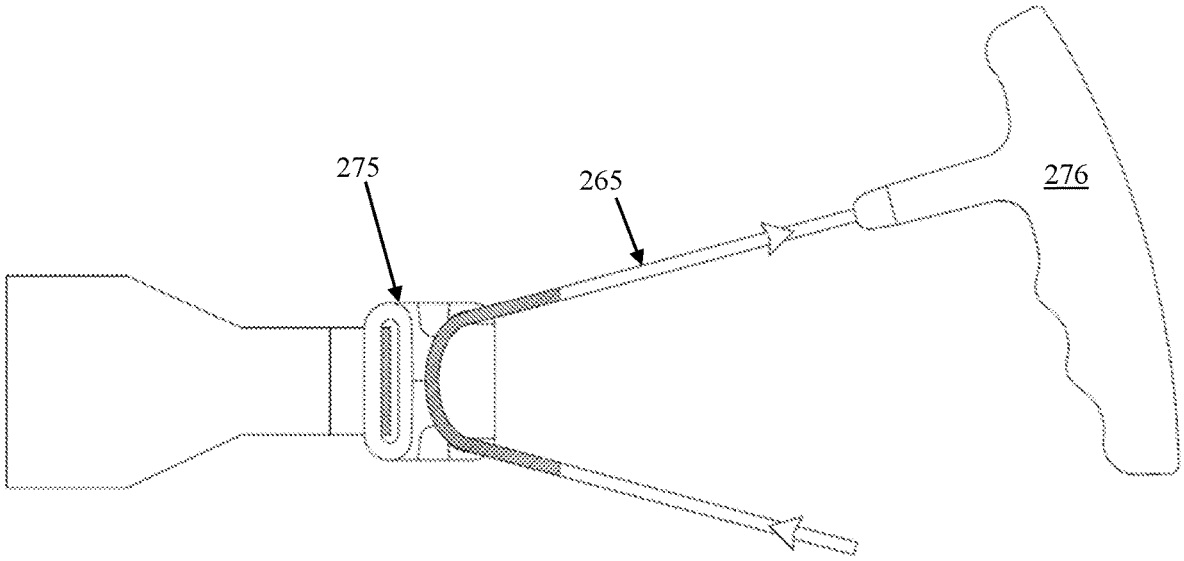

FIG. 2 illustrates a stretching device 200 in accordance with another embodiment of the invention, in which the sheaveless blocks 270, 275 are used as pulleys. Otherwise the elements shown in FIG. 2 and not discussed are the same as the elements described above in relation to FIG. 1. Referring to FIG. 2*b*, the elliptical profile presented by block 275 can be seen. This confines the rope 265 to an elliptical path where it passes through the block 275 under tension. The friction surface presented to the rope 265 by the block 275 thus maximises static friction when the rope is not moving, thereby minimising the force which must be maintained by the user on the handle 276 while holding a stretch.

Figure 3:
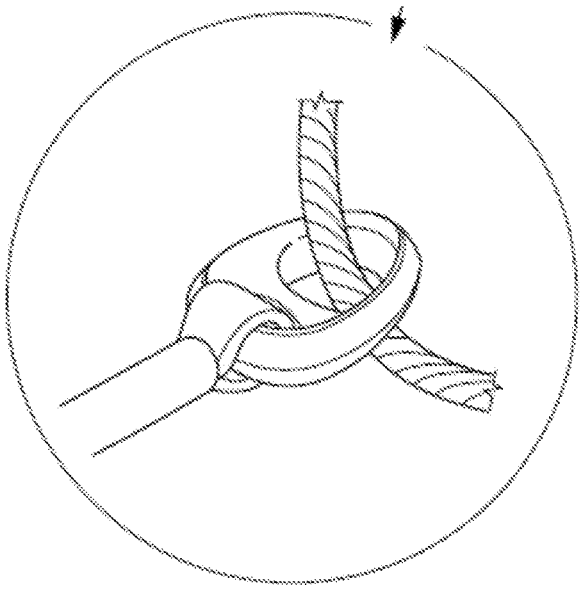
FIG. 3 illustrates a sheaveless block for a hand controlled leg stretching and activation device in accordance with a further embodiment of the present invention.

FIG. 3 illustrates a sheaveless block used in yet another embodiment of the invention.

Figure 4:
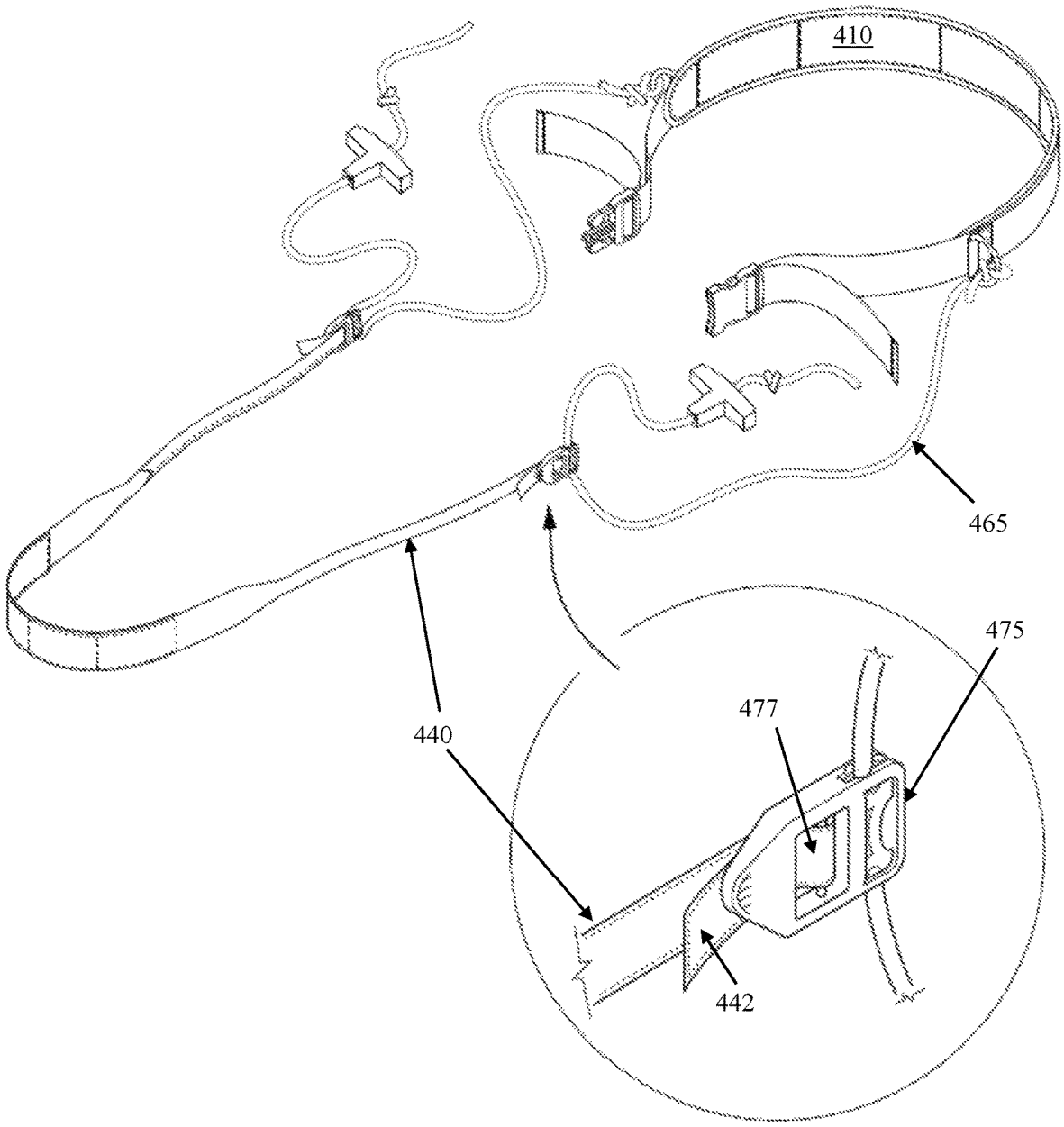
FIG. 4 illustrates a hand controlled leg stretching and activation device in accordance with yet another embodiment of the present invention.

FIG. 4 illustrates a hand controlled leg stretching and activation device in accordance with yet another embodiment of the present invention. It is to be understood that elements shown in FIG. 4 but not described here correspond to the same elements in FIGS. 1, 2 and/or 3. However, in the embodiment of FIG. 4 both free ends of the foot stirrup 440 are threaded through respective buckles 477 provided upon the sheaveless blocks 475. In this manner, the length of the foot stirrup 440 can be adjusted simply by adjusting the free end 442 of the foot stirrup 440. In particular, adjustment of the length of the foot stirrup can thus be simply and swiftly achieved, independently of the length of the ropes 465, and also independently of the girth of the lower back brace 410. Such independent adjustment of the length of the various components of the device can be particularly advantageous when the device is to be configured for use by persons of different leg length, different girth or different flexibility. Providing for such adjustment of the foot stirrup 440 allows for very easy fine tuning of the device to the particular user, and for example simplifies the task of generating a small amount of pre-tension on the cords 465, so that in a neutral position where the user is not actively stretching the foot stirrup 440 stays on the foot where it has been located.

When the device of FIG. 4 is used to perform a calf stretch where the foot stirrup 440 is located on the ball of the foot, if there weren't some degree of tension in the cord the foot stirrup 440 would undesirably tend to fall towards the user's heel. Generating a small amount of pre-tension on the cords 465 is thus useful to avoid this occurring.

Figure 5:
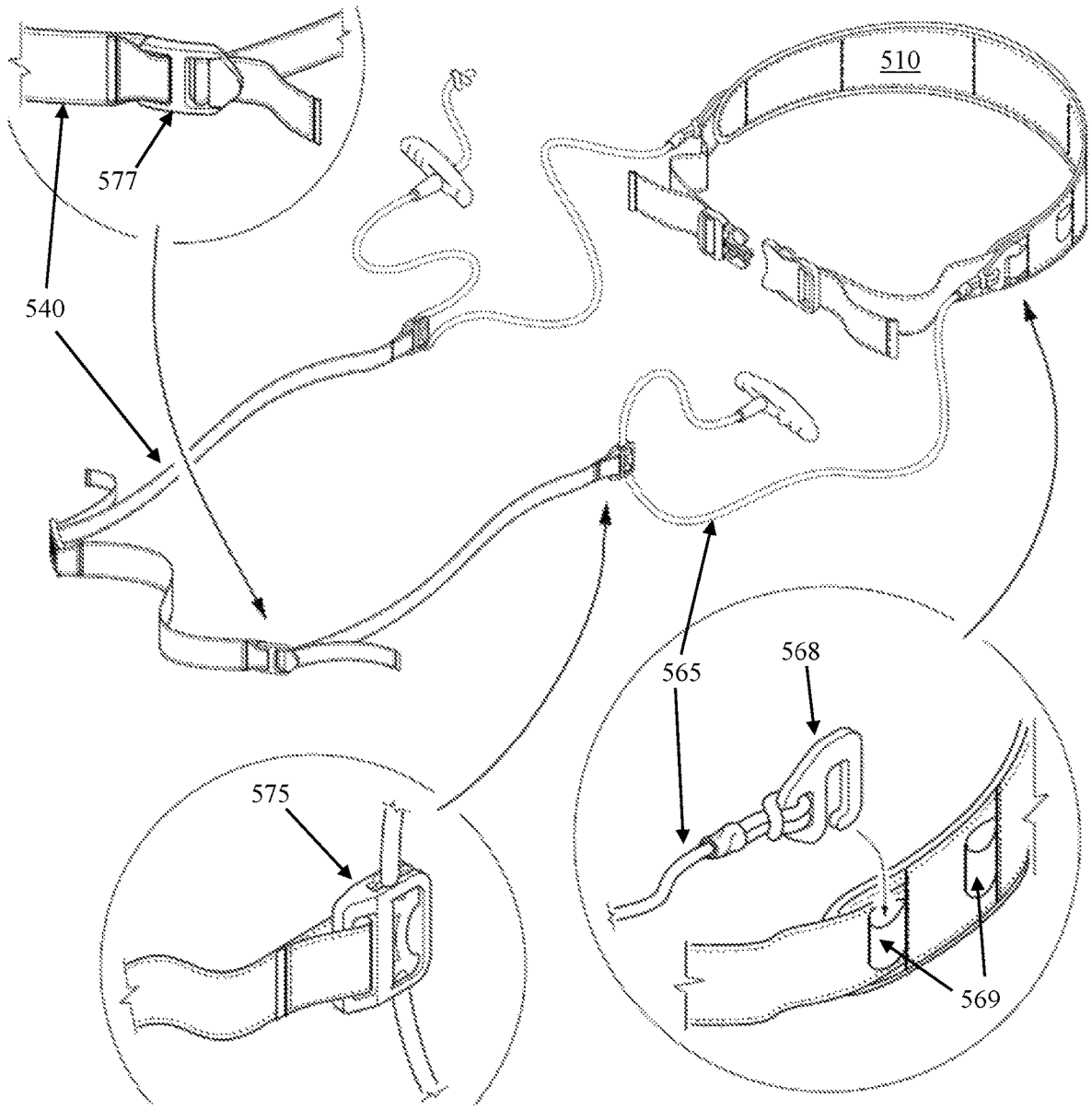
FIG. 5 illustrates a hand controlled leg stretching and activation device in accordance with a further embodiment of the present invention.

FIG. 5 illustrates a hand controlled leg stretching and activation device in accordance with a further embodiment of the present invention. It is to be understood that elements shown in FIG. 5 but not described here correspond to the same elements shown in, and/or described in relation to, any one of FIGS. 1-4. The embodiment of FIG. 5 utilises a ladder lock system comprising a respective ladder hook 568 terminating one end of each of the cords 565, configured to be releasably captured by any one of a plurality of ladder loops 569. The ladder loops 569 are fixed to the lower back brace 510 at suitably graduated positions. The ladder lock system thereby provides a simple and efficient means by which the cord length can be adjusted and the point of attachment of the cords 565 to the brace 510 can be selected, which for example can be desirable for users of differing girth.

The ladder hook 568 may be formed of any suitable material, such as aluminium, injection moulded plastic or a 3D printed material. In this embodiment two ladder loops 569 are provided, to permit coarse adjustment between users of large girth who might use the loop 569 located closest to the foot stirrup 540, and user of smaller girth who can use the loop 569 located furthest from the foot stirrup 540. Alternative embodiments may provide any suitable larger number of loops 569.

The embodiment of FIG. 5 also notably provides buckles 577 for adjustment of the length of the foot stirrup 540. The benefits of buckle adjustment of the length of the foot stirrup are as described above in relation to FIG. 4, however in the embodiment of FIG. 5 the buckles 577 are provided distal from the respective sheaveless block 575, as may be useful in some circumstances.

Figure 6:
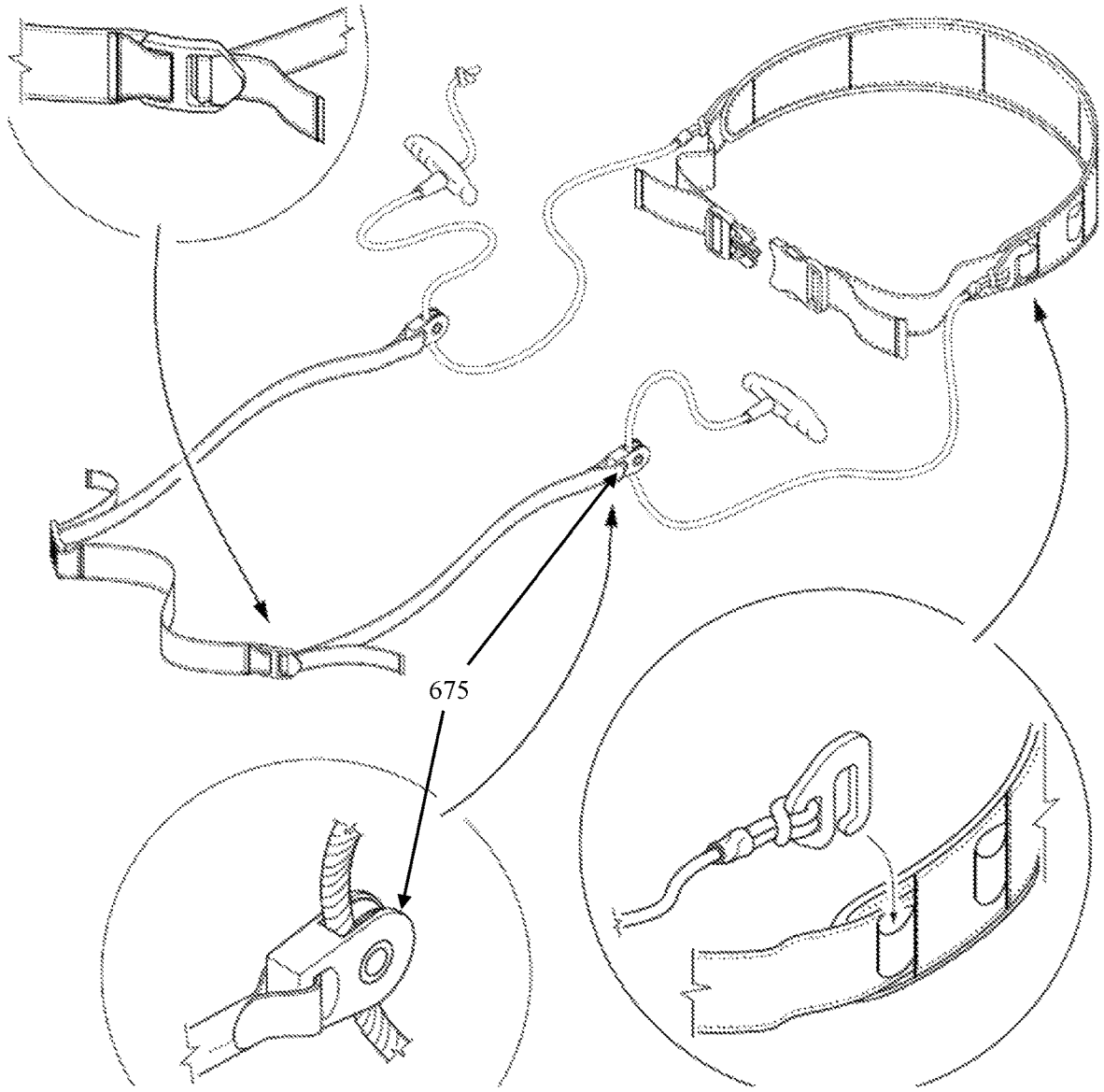
FIG. 6 illustrates a hand controlled leg stretching and activation device in accordance with a yet further embodiment of the present invention.

FIG. 6 illustrates a hand controlled leg stretching and activation device in accordance with a yet further embodiment of the present invention. The embodiment of FIG. 6 utilises pulleys 675 to movably contain the cords 665. The embodiment of FIG. 6 is otherwise the same as the embodiment of FIG. 5 and common elements are not discussed further.

Providing for adjustment of the foot stirrup length by buckle or otherwise, and/or providing for ladder lock adjustment or equivalent adjustment of the back brace attachment point, as shown in the embodiment of FIG. 4, FIG. 5 and/or FIG. 6, can be particularly advantageous in providing for a device which is shared between several users. The relatively fine control provided by the buckles 477 and/or 577 enables users to make any fine sizing adjustments much more quickly and accurately than is the case for undoing and retying knots. Moreover, where the users are of relatively different sizes, the ladder lock adjustment provides for quick coarse adjustment of the device fitting, and as a second step the buckles 477/577 can then be used to finish off a fine leg strap adjustment.

The embodiments of FIGS. 1-6 thus provide for opportunities for device adjustment to cater for users of different leg length, girth and/or flexibility. In contrast to other devices, at least some of the described embodiments of the present invention can cater for the large variations which can occur between users, particularly in light of the rising proportion of overweight or obese persons and the elderly.

In the embodiments of FIGS. 1-6 the user is able to simultaneously stabilize and support any directional changes and or loads being applied to specific leg muscle groups and their associated connective tissue that have been targeted as part of the stretching process. These stretches can be independently performed in either a seated position or lying on ones back (muscles can relax as they are not weight bearing) without having to rely on any external support mechanism i.e. furniture props, walls etc. The hand controlled leg stretching devices 100, 200, etc allow the user to effectively target specific leg muscle groups and their interrelationships i.e. calves, lateral calves, hamstrings, Iliotibial Band (ITB), Tensor Fasciae Lateae (TFL) and Gluteus muscle groups and their associated connective tissue.

Figure 7A:
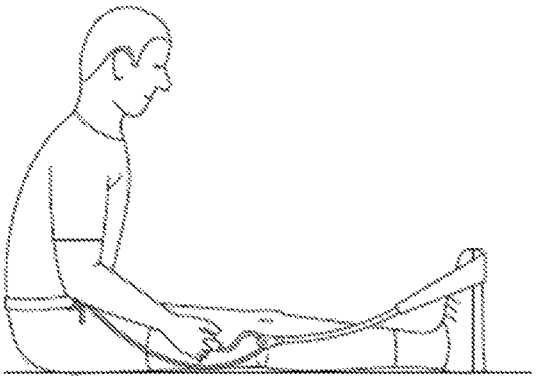
FIGS. 7 to 17 illustrate stretching by a user using the devices of FIGS. 1 and 2.
Figure 7B:
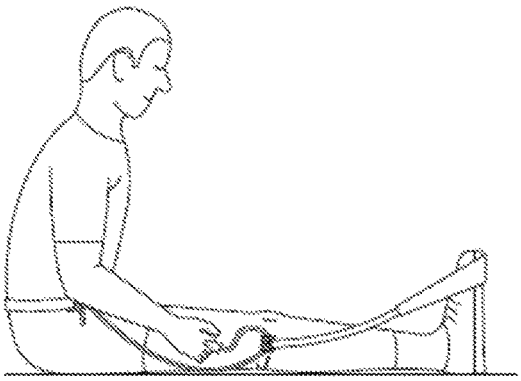

FIG. 7*a* shows an individual in a seated position with the dual hand controlled leg-stretching device 100, prior to the commencement of performing a calf stretching routine. FIG. 7*b* shows the same position using the device 200. In FIG. 7 the user is in a seated position with both their legs extended out in front of them. The user's spine is incorrectly aligned as it is slumped forward with convex lumbar curvature. The foot strap 140 is located on the ball of the right foot with the foot being in a neutral starting position (upright).

Figure 8A:
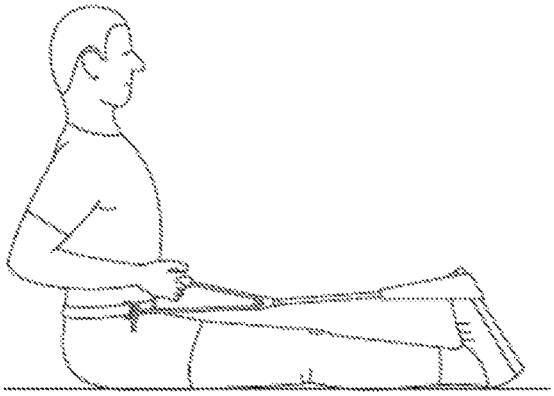
Figure 8B:
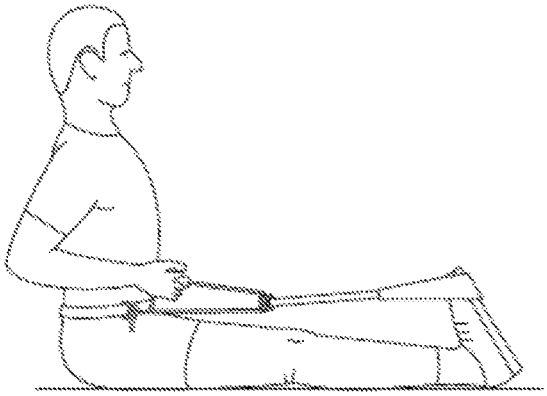

FIGS. 8*a* and 8*b* show a seated calf muscle stretch position utilizing the respective dual hand controlled leg-stretching devices 100, 200. The user's spine is being aligned in the correct position as the back support 110 is being urged towards the foot stirrup 140. This seated stretching position is performed with both the user's legs extended out directly in front of them and is generally used as a stretching position for individuals who are extremely restricted in their leg muscle groups, such as the calf and hamstring muscle groups. As the user pulls on the dual hand controls they simultaneously aid the stretching process by sitting upright and straightening their back with their right foot drawn towards their body (dorsi flexion) allowing the calf muscles to be targeted. While the stretching process is taking place the user's back is being supported by the back support 110, allowing the user to partially relax and concentrate less on trying to hold their spine in the correct alignment. This ability to be able to relax helps to facilitate the desired stretching response. The ability to elicit the correct alignment of an individual's spine who is generally exhibiting tightness in their leg musculature is usually enough to facilitate a desirable stretching response in the targeted muscle groups, in this particular example the right calf muscle.

As the handles attached to the dual control lines move towards the body to facilitate the stretching response they have to travel approximately twice the distance for approximately half the load on the user's arms and their lower back as to that which is being applied to the user's targeted leg muscle groups due to the mechanical advantage afforded by this leg stretching system. This increased distance of travel of the handles encourages the shoulders to roll back, as is desirable. This mechanical advantage also has the desirable outcome that forces being applied to the lower back are such that they only have to move a relatively small distance to align and support the spine in the stretching process. This stretching process can in turn also be performed on the left calf muscle by placing the foot strap on the ball of the left foot.

In FIG. 8*b* greater friction is generated due to the two sheaveless blocks, which reduces the stretch holding force which must be applied to the handles.

Figure 9A:
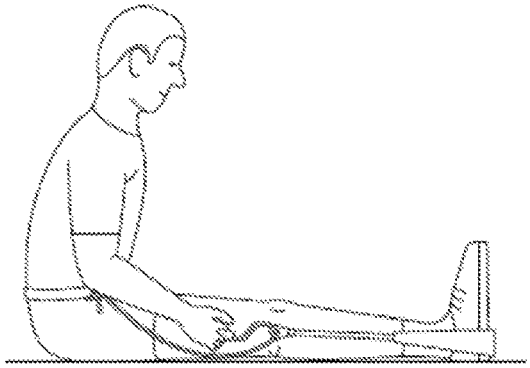
Figure 9B:
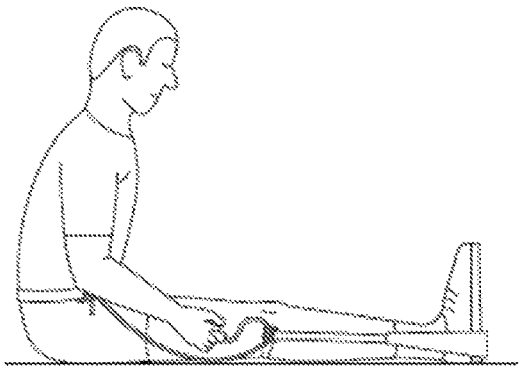
Figure 9C:
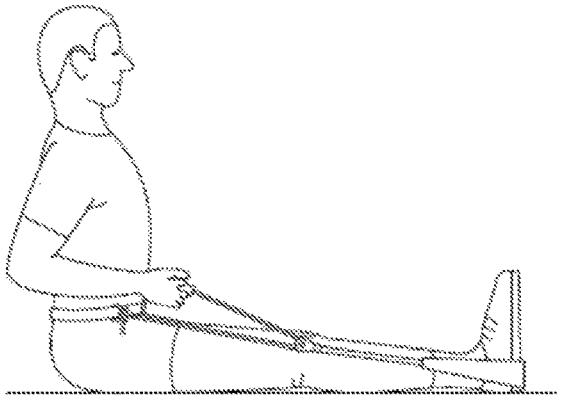
Figure 9D:
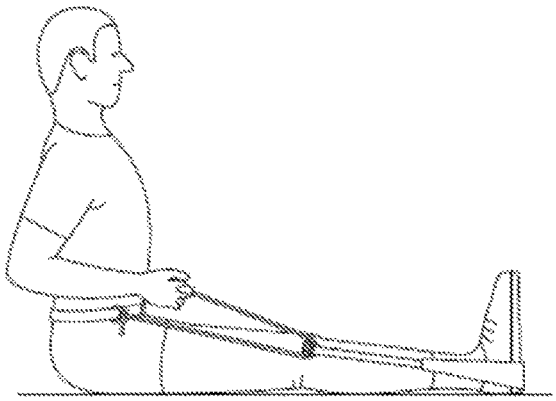

FIGS. 9*c* and 9*d* show a seated hamstring muscle stretch position utilizing the hand controlled leg-stretching device 100, 200, respectively. The user's spine is being aligned in the correct position via the back support 110. This seated stretching position is performed with both the user's legs extended directly out in front of them and is generally used as a stretching position for individuals who are extremely restricted in their leg muscle groups—especially the calf and hamstring muscle groups. As the user pulls on the dual hand controls this simultaneously allows the user to sit upright and straighten their back due to the controlled alignment afforded by the back support with the desired force being applied to the heel while foot remains in a neutral upright position allowing the hamstring muscles to be effectively targeted. As the stretch process is taking place the user's back is also being supported by the back support 110, allowing the user to relax and not have to concentrate on trying to hold their spine in an upright alignment. This ability to be able to relax helps to facilitate the desired stretching response, and protects the spine from potentially dangerous flexional loads. The correct alignment of an individual's spine who is exhibiting considerable tightness in their leg musculature is generally enough to facilitate a desirable stretching response in the targeted muscle groups, in this particular example the hamstring muscles. As the handles attached to the dual control lines move back towards the body to facilitate the stretching process they have to travel approximately twice the distance for approximately half the loads on the user's arms and their lower back as there is being applied to the user's targeted leg muscle groups due to the mechanical advantage of this leg stretching system. This mechanical advantage also has the desirable outcome where the force that are being applied to the lower back are such that they only have to move a relatively small distance to align and support the spine in the stretching process. This same mechanical advantage applies to all the stretches that this leg stretching system is able to perform.

It should be noted that all the above-mentioned seated calf and hamstring stretches are often used as a preliminary stretching routine before moving onto the more advanced stretching routine whereby the user can lay on their back and perform more advanced stretching routines that effectively target more leg muscle groups or combinations of muscle groups in the same safe and controlled manner. These stretches are as follows.

Figure 10A:
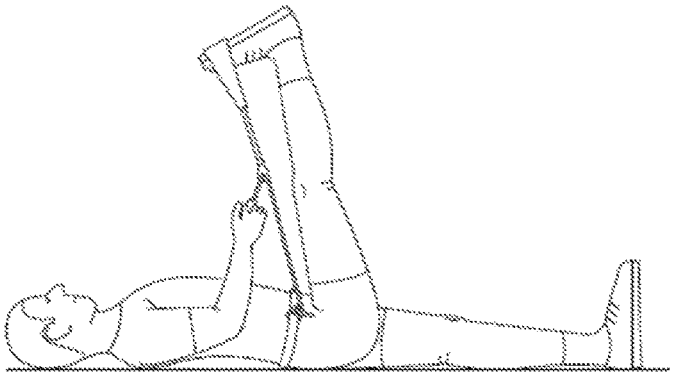
Figure 10B:
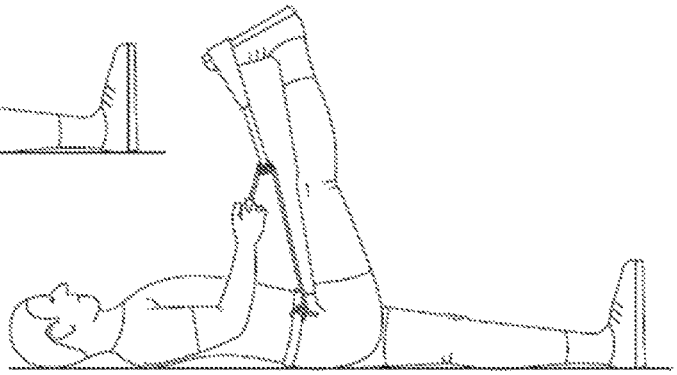
Figure 11A:
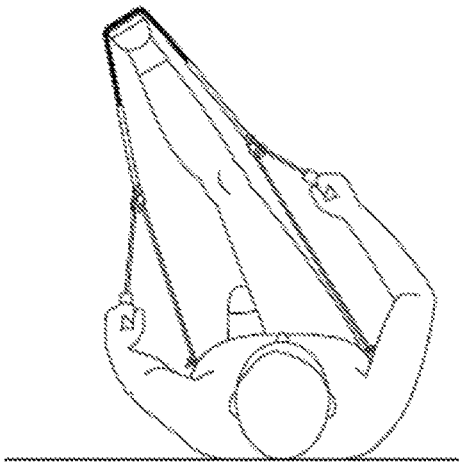
Figure 11B:
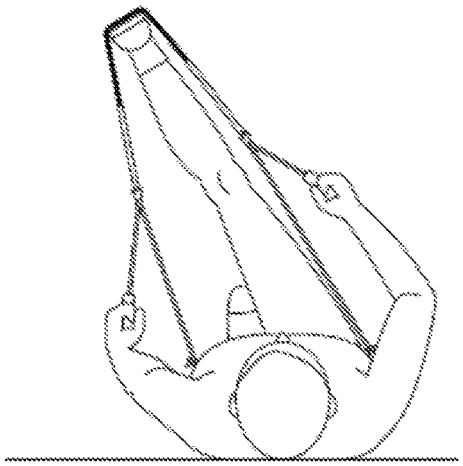
Figure 12A:
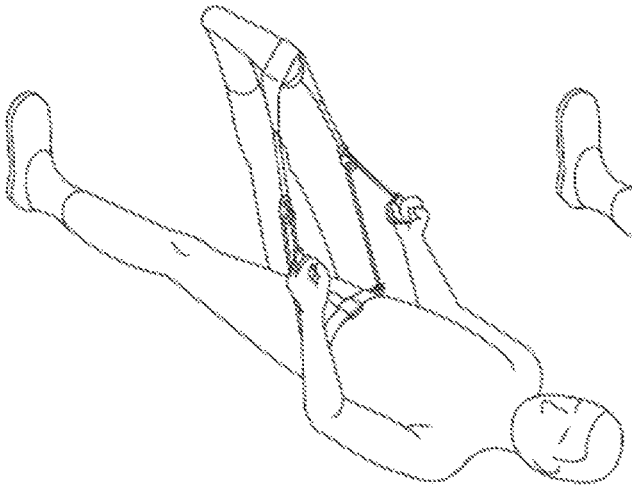
Figure 12B:
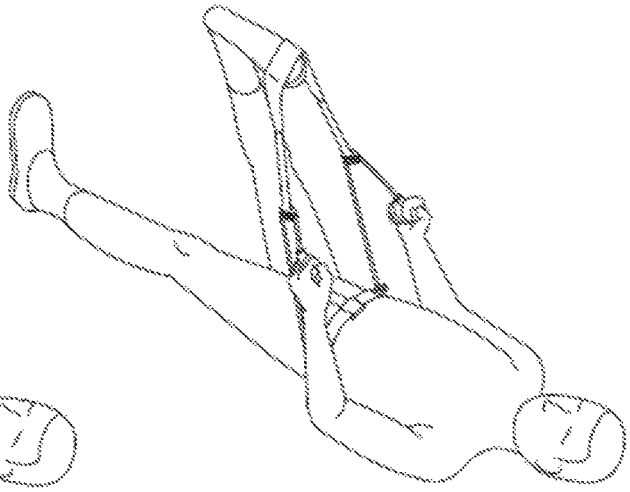
Figure 13A:
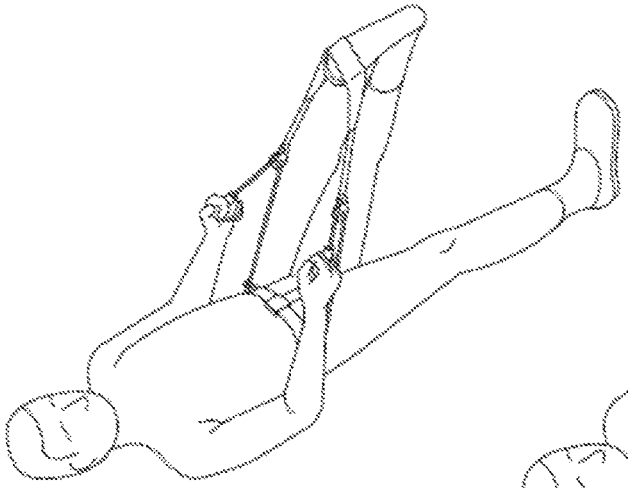
Figure 13B:
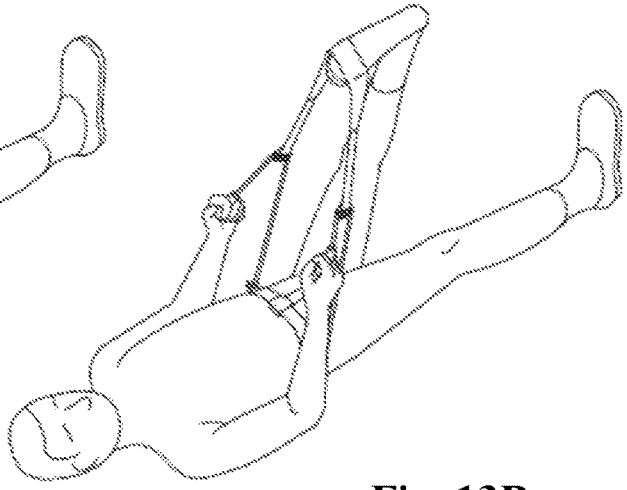
Figure 14A:
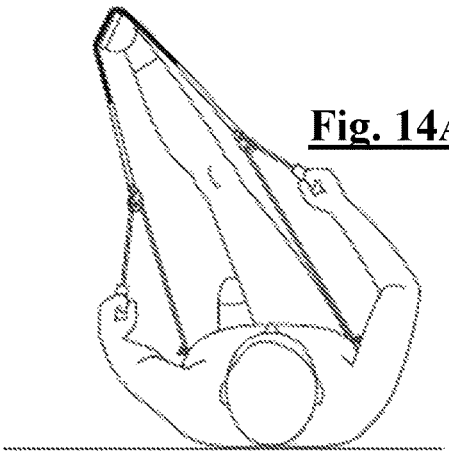
Figure 14B:
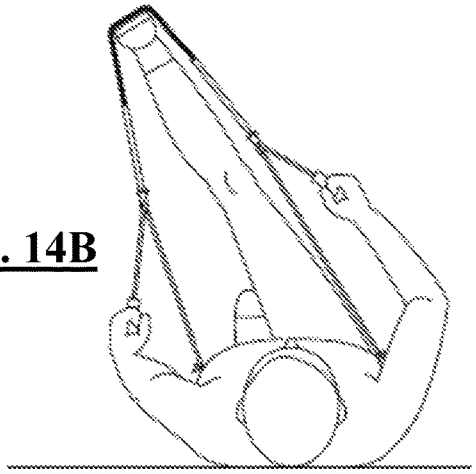

FIGS. 10*a* and 10*b* show the user laying on their back with their right leg raised in an upright position while stretching their right calf muscle (right foot in dorsi flexion), using the device 100 and 200, respectively. This stretching technique can be applied to either the left or right calf depending on which leg is in the raised position with the foot strap for this particular stretch being position on the ball of the right foot. Note the lower back is raised slightly off the ground as a result of the back support 110 correctly aligning the lower back, which also helps to keep the pelvis in the correct alignment. This is a more advanced stretch than the seated calf muscle stretch position of FIG. 8, as the left leg in FIG. 10 is positioned out straight (as opposed to both legs being out straight), which also facilitates the alignment of the back in relation to the pelvis due to the straight left leg maintaining contact with the ground, while at the same time drawing the user's right leg towards the direction of their head, the stronger the stretching response is on the right calf muscle. This controlled positioning of the body and limbs in relation to each other gives a greater degree of control/confidence meaning there is less chance of misaligning the spine as the lower back and hands are moving towards each other in relatively the same plane. This stretching technique of laying on the back is more in keeping with what an athlete would utilize, as the ability to increase the angle of the leg, while keeping the relationship between pelvis and lower back correctly aligned while keeping the non-stretched leg as straight as possible while maintaining contact with the floor all contribute to a very effective stretching response, without placing unnecessary flexional loads on the spine. It should be noted that as the vertical leg being stretched moves towards the direction of the user's head the loads being applied to the lower back still remain relative (half that being applied to the leg musculature) because the intensity of the stretch is also being affected by the increasing angle of the leg thus the 2:1 ratio remains intact. The overall improved stretching position afforded by this leg stretching system is a considerable improvement on general stretching practices that utilize a strap, for stabilization effect of the two dual control lines, which can move the targeted leg, foot into any number of positions depending on what stretch is being utilized and then hold them in position with a high degree of control with minimal loads being applied to the arms, shoulder and neck as the body can remain in a relatively relaxed and supine position. Any stretching position where the user is having to balance while attempting to perform a stretching routine is compromising the effectiveness of the stretch (especially someone who is inflexible i.e. tight, injured, elderly individuals) as the targeted leg muscle groups need to be able to relax as much as possible for an effective stretching outcome to be achieved and this also minimises the risk of injury for unnecessary contractions of targeted muscle groups, losing balance/falling over whilst in a standing position.

FIGS. 11-14 show the stretching of the lateral lower leg muscle groups. FIGS. 11*a*, 12*a*, 13*a*, 14*a* using device 100 and FIGS. 11*b*, 12*b*, 13*b*, 14*b* using device 200. FIG. 12(A) being the right lateral lower leg and FIG. 13(A) being the left lateral lower leg with FIG. 14(A) showing a head on view, which illustrates the stretching of the right lateral lower leg muscle groups in this particular example. For any of these lower lateral leg stretches to be performed correctly the foot/ankle has to be rolled in an inward direction (inversion) with the foot strap located around the ball of the foot. Once the user has rolled the ankle over to a comfortable angle any desired increase in the stretch of the lateral lower leg muscle groups can be achieved by moving the whole leg in the same direction as the ankle while keeping the entire leg in a relatively straight alignment. Utilising this technique allows the user to effectively target the muscle of the lateral lower leg (both left and right leg) without placing excessive loads on the ankle joint by trying to make the ankle joint excessively roll in an inward direction. The aim of a good stretching routine is to target the muscles without placing excessive loads on the joints. Because this invention utilizes dual hand controls the user is able to control and support the direction of the leg in any given direction, as the dual control lines attach to the body at either side of the back support. This effectively triangulates the user leg allowing a necessary degree of force and stabilization to be applied simultaneously. It should in this particular stretch be noted that the inside hand control applies the force to the ankle joint, which is tilted in an inward direction (inversion), which in turn elicits a stretch response in the associated lower lateral leg muscle groups, while the outside hand control helps to control the angle of the leg as it moves across the body, which in turn regulates how much force is being applied to the targeted lateral lower leg muscle groups. This system also allows the user the ability to not over balance and topple over in the direction which the upright leg is leaning and most importantly allows the user to remain relaxed and achieve a better stretching response and also minimizes the risk of injury due to affording the user a better mechanism for controlling the entire stretching process.

Figure 15A:
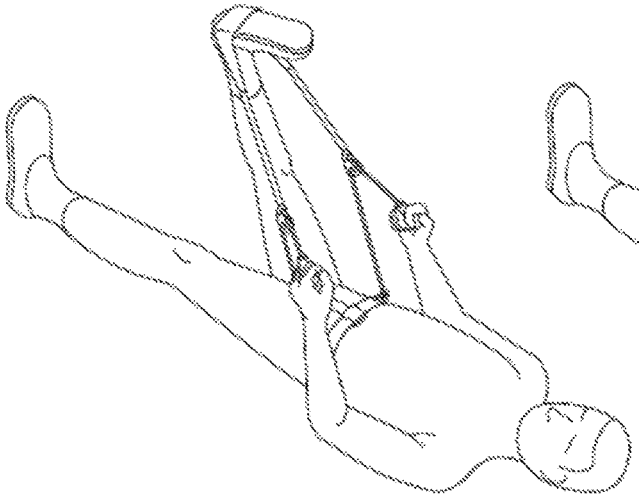
Figure 15B:
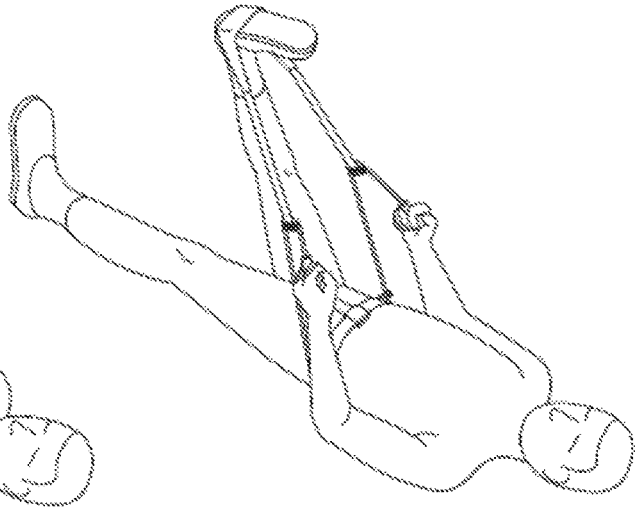
Figure 16A:
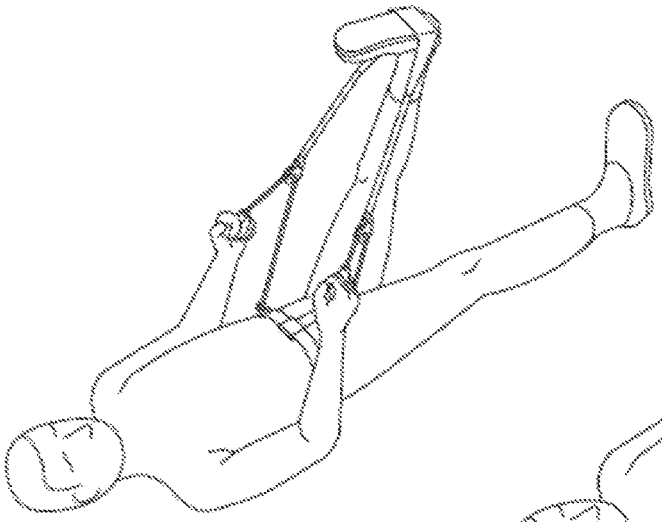
Figure 16B:
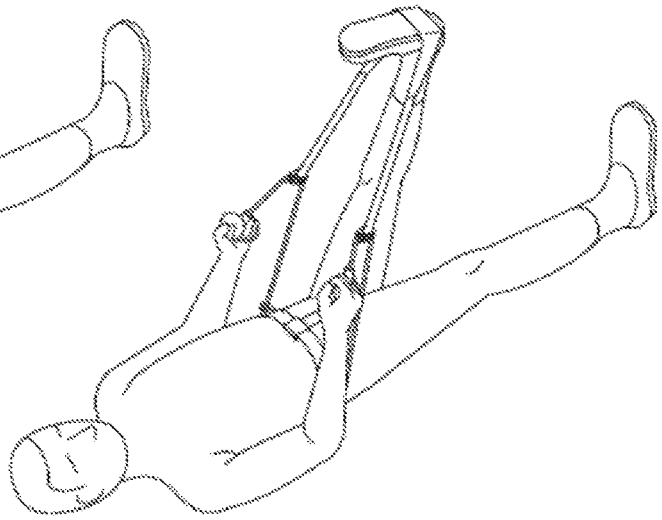
Figure 17A:
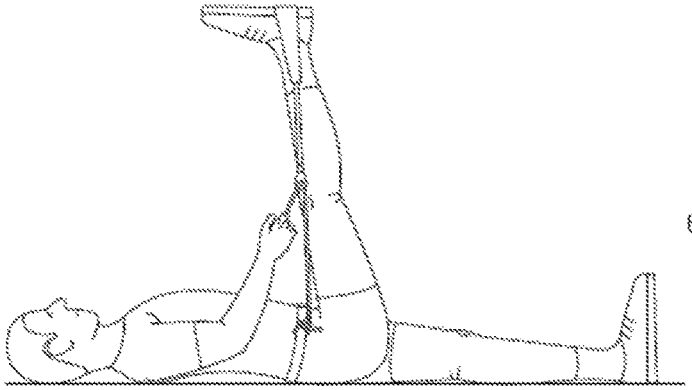
Figure 17B:
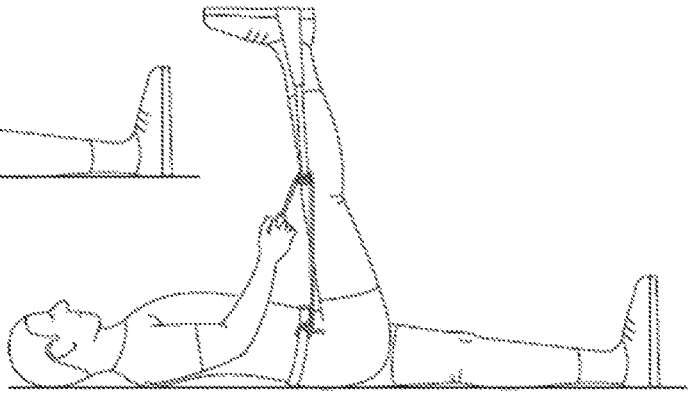

FIGS. 15 to 17 show the stretching of the upper lateral leg muscle groups in particular the Iliotibial band (ITB) and Tensor fasciae latae (TFL) leg muscle groups with 16(A) being the left upper lateral leg muscle groups and 17(A) being the right upper lateral leg muscle groups with 11(A) showing a head on view, which illustrates the stretching of the right upper lateral leg muscle groups in this particular example. For any of these upper lateral leg stretches to be performed correctly the foot and ankle have to remain in a neutral position while the foot strap is located on the heel of the foot. Once the user has positioned the leg to an upright position where they feel comfortable and are not placing excessive loads on the hamstring they can move the leg they are stretching across to the desired angle where they can feel the onset of the stretch they can increase the intensity of the stretch by pulling on the handles or performing combinations of all of the above increase upright position of leg, increase cross angle of leg or apply more force to the leg by pulling on the handles. What separates this stretch from the lower lateral leg stretch is that the foot/ankle all remain in a neutral position.

The aim of a good stretching routine is to target the muscles and not place excessive loads on the joints. Because this invention utilizes dual hand controls the user is able to control and support the direction of the leg in any given direction, as the dual control lines attach to the body at either side of the back support. This effectively triangulates the user's leg allowing a necessary degree of force and stabilization to be applied simultaneously. It should be noted in this particular stretch that both hand controls not only control the force being applied to the heel of the foot while in a neutral position but also controls the vertical and lateral positioning of the leg, all of which in turn elicits a stretch response in the associated upper lateral leg muscle groups. Just as in the lateral lower leg stretch, this system also allows the user the ability to not over balance and topple over in the direction which the upright leg is leaning and most importantly allows the user to remain relaxed and achieve a better stretching response and also minimizes the risk of injury due to affording the user a better mechanism for controlling the entire stretching process.

Some embodiments of the invention may utilise 3D printing for construction of some or all of the device. Accordingly, in some embodiments the present invention may reside in a digital blueprint comprising a digital file in a format configured for use with rapid prototyping and computer aided design (CAD) and/or manufacturing, such as being in the STL (stereolithography) file format. Such digital blueprint files, whether produced by performing a three dimensional scan of an embodiment of the invention, or produced by a CAD development software tool, or the like, are within the scope of the present invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not limiting or restrictive.

The invention claimed is:

1. An independent stretching device comprising:

a back brace configured to pass across and brace against a user's back;

a first connector secured to a first end of the back brace, the first connector being threaded through only a first single pulley;

a second connector secured to a second end of the back brace on an opposite side of the user to the first end of the back brace, the second connector being threaded through only a second single pulley; and a foot stirrup for receiving a foot of the user, the foot stirrup having a first end connected to the first single pulley and a second end connected to the second single pulley;

whereby tension applied to a distal end of the first connector distal from the back brace, and tension applied to a distal end of the second connector distal from the back brace creates tension which urges the foot stirrup and the back brace toward each other.

2. The device of claim 1 wherein the back brace is releasably fastenable around the torso of the user.

3. The device of claim 2 wherein the back brace is releasably fastenable by use of a snap-clip side release buckle.

4. The device of claim 3 wherein the back brace is a lower back brace.

5. The device of claim 4 wherein the first and second connector each comprise a flexible rope.

6. The device of claim 5 further comprising a first handle secured to an end of the first connector distal from the back brace, whereby the first single pulley is interposed between the first handle and the back brace, and further comprising a second handle secured to an end of the second connector distal from the back brace, whereby the second single pulley is interposed between the second handle and the back brace.

7. The device of claim 6 wherein the foot stirrup is configured to receive either one foot of the user or both feet of the user at a time.

8. The device of claim 1 wherein each pulley comprises a sheaved block.

9. The device of claim 1 wherein each pulley is a sheaveless block.

10. The device of claim 9 wherein the sheaveless blocks are formed of a material presenting a higher static coefficient of friction with the respective connector when stationary and under tension, and presenting a lower dynamic friction with the respective connector when in motion.

11. The device of claim 10 wherein each sheaveless block is configured to present a friction surface which takes a shape which enhances static friction with the respective connector when stationary and under tension.

12. A method of independent stretching, the method comprising:

positioning a back brace across, and braced against, a user's back;

positioning a foot of the user in a foot stirrup; and applying tension to distal ends of first and second connectors, wherein:

the first connector is threaded through only a first single pulley secured to a first end of the foot stirrup;

the second connector is threaded through only a second single pulley secured to a second end of the foot stirrup; and each of the first connector and the second connector extends from the respective single pulley to be secured to respective first and second ends of the back brace on opposite sides of the user, to thereby urge the foot stirrup and the back brace toward each other.

13. A non-transitory computer readable medium for independent stretching, comprising instructions making up a digital blueprint file which, when executed by one or more processors, causes performance of the following:

three-dimensional printing of a back brace configured to pass across and brace against a user's back;

three-dimensional printing of a first connector secured to a first end of the back brace, the first connector being threaded through only a first single pulley;

three-dimensional printing of a second connector secured to a second end of the back brace on an opposite side of the user to the first end of the back brace, the second connector being threaded through only a second single pulley; and three-dimensional printing of a foot stirrup for receiving a foot of the user, the foot stirrup having a first end connected to the first single pulley and a second end connected to the second single pulley;

whereby in use tension applied to a distal end of the first connector distal from the back brace, and tension applied to a distal end of the second connector distal from the back brace creates tension which urges the foot stirrup and the back brace toward each other.

14. The device of claim 1, wherein:

the back brace comprises a first ring and a second ring;

when the back brace is worn by the user the first ring and the second ring are respectively located approximately at the user's left hip and right hip;

an end of the first connector is coupled with the first ring; and an end of the second connector is coupled with the second ring.

* * * * *